US008256038B2

(12) United States Patent
Hunter

(10) Patent No.: US 8,256,038 B2
(45) Date of Patent: Sep. 4, 2012

(54) WATER-CONSERVING URINAL BLOCK AND HOLDER

(76) Inventor: Jay D. Hunter, Goffstown, NH (US)

( * ) Notice: Subject to any disclaimer, the term of this patent is extended or adjusted under 35 U.S.C. 154(b) by 0 days.

(21) Appl. No.: 13/052,261

(22) Filed: Mar. 21, 2011

(65) Prior Publication Data

US 2011/0162134 A1 Jul. 7, 2011

Related U.S. Application Data

(62) Division of application No. 12/276,629, filed on Nov. 24, 2008, now Pat. No. 7,921,479.

(51) Int. Cl.
*E03D 13/00* (2006.01)

(52) U.S. Cl. ..... 4/309; 4/231; 4/222; 422/5; 510/192; 510/101

(58) Field of Classification Search ..... 4/309, 301, 4/227.1, 310; 510/191, 192; 422/5
See application file for complete search history.

(56) References Cited

U.S. PATENT DOCUMENTS

| | | | | |
|---|---|---|---|---|
| 4,578,207 | A * | 3/1986 | Holdt et al. | 510/192 |
| 4,666,671 | A * | 5/1987 | Purzycki et al. | 422/5 |
| 5,365,616 | A * | 11/1994 | Morad | 4/309 |
| 2002/0116753 | A1 * | 8/2002 | Mitchell et al. | 4/301 |
| 2005/0202988 | A1 * | 9/2005 | De Belder et al. | 510/191 |
| 2005/0247342 | A1 * | 11/2005 | Higgins | 137/247.13 |
| 2006/0101565 | A1 * | 5/2006 | Cummings | 4/309 |

* cited by examiner

*Primary Examiner* — Gregory Huson
*Assistant Examiner* — Lauren Heitzer
(74) *Attorney, Agent, or Firm* — Robert R Deleault, Esq; Mesmer & Deleault, PLLC

(57) ABSTRACT

A urinal block for use in a conventional water-based urinal where the water has been shut off, the block includes a first block portion that makes up about forty percent to sixty percent of the urinal block and has a first portion composition substantially similar to a conventional, non-paradichlorobenzene block used in water-based urinals for deodorizing during each flush, a second block portion that makes up about forty to sixty percent of the urinal block and has a second portion composition of a blended mixture of a non-paradichlorobenzene block portion, an odor counteractant gel, and a bacterial culture gel, and a liquid-pervious and liquid-insoluble layer covering at least the second block portion.

17 Claims, 2 Drawing Sheets

WATER-CONSERVING URINAL BLOCK AND HOLDER

This application is a Divisional Application of Ser. No. 12/276,629, filed on Nov. 24, 2008, now U.S. Pat. No. 7,921, 479 issued on Apr. 12, 2011.

BACKGROUND OF THE INVENTION

1. Field of the Invention

The present invention relates generally to urinals. Particularly, the present invention relates to urinal blocks and holders. More particularly, the present invention relates to water-conserving urinals.

2. Description of the Prior Art

The typical men's restroom-provided urinal is a vertically disposed, porcelain-surfaced receptacle having a collection region at the bottom of the receptacle with a drain. Vertical, smooth-sided walls extend above the collection region to provide a surface to receive urination streams and over which water used to flush the urinal is directed. Urinal devices typically are wall mounted or floor mounted, though wall mounted versions are currently more commonplace.

In the customary urinal, a small amount of water remains in the collection area between flushes to dilute the urine being collected. This water remains at ambient temperatures much like water in a commonly used toilet bowl between flushes. Some portion of the ambient water pool is accessible in the bottom of the urinal. The drain opening may be covered by a screen or a grid or it may include openings in the sidewalls of the urinal or in a projecting hub disposed near the bottom of the collection region. These standard urinals must be flushed with water following each use in order to maintain a reasonably sanitary condition.

It is well known in the janitorial field that there are common problems encountered when maintaining restroom urinals. It is desirable for sanitary and ambiance purposes to provide a means for deodorizing and sanitizing the urinals. One of the earliest efforts at providing health protection for urinals was to use a solid block of paradichlorobenzene (PDB). These blocks, also known as para blocks, were not positioned in the urinal in any particular way. Rather, they were merely tossed into the urinal. Since PDB sublimed at room temperature, it had a characteristic odor in use. PDB, however, is substantially insoluble in water. As a result, the PDB evaporated continuously, rather than being dispensed at the time of flushing. Later, perfumes and germicides were added to PDB blocks. This improved the ability of the para blocks to provide some cleaning and odor-covering properties. However, the blocks still sublimed at room temperature and were insoluble in water. The problem of unnecessary use at some times, followed by no use at others, was not solved.

To solve this problem, non-PDB or non-para blocks were devised. These blocks did not use PDB but incorporated various ingredients in a water-soluble combination. These blocks included surfactant cake compositions, compositions of polyethylene oxide resins and water-soluble inert salts such as alkali metal chlorides and sulfates used to act as a filler to allow the compositions to be formed into cakes/blocks of desirable size. The predominant ingredients of these non-para block/cake compositions are usually the surfactant, perfume and the filler salt. Anionic, nonionic, ampholytic, zwitterionic, or cationic surfactants are used with the anionics being the most preferred.

U.S. Pat. No. 4,278,571 (1981, Choy) discloses a solid cake composition that includes from about 20% to 50% of a naphthalene sulfonate surfactant and from about 30% to 80% of a water-soluble salt. The ratio of the surfactant to the salt is in the range of about 1:0.3 to 1:4.

U.S. Pat. No. 4,310,434 (1982, Choy et al.) discloses a solid cake composition that includes polyethylene oxide, surfactant and water-soluble salt. The composition has controlled solubility characteristics to reduce the tendency of the resin to form a gel when the cake is contacted with water. These cakes are useful in dispensers that are employed in the flush tank of a toilet to automatically dispense chemicals to the flush water.

U.S. Pat. No. 4,477,363 (1984, Wong et al.) discloses a solid cake composition that includes 1% to 15% free fatty alcohol and 20% to 90% buffered alkali earth metal alkyl sulfate surfactant. Perfume, dye or salt, or any combination can be added to the cake composition.

There has also been devised various holders for retaining the para and non-para blocks within the urinals. U.S. Pat. No. 5,489,415 (1996, Van Vlahakis et al.) discloses a urinal block dispenser assembly and composition. The assembly and block includes a fluid-soluble chemical composition and an improved dispenser to be used with the urinal block. The device includes the use of an acid stable protease enzyme. The urinal block is retained in and dispensable from a disposable dispenser assembly for use in urinals and toilets. The urinal block is protected from direct action of urine by a retention cup that retains the chemical composition block.

Water conservation is gaining increased importance in our society. Many areas in the country are suffering the effects of long term drought. In these areas, water conservation is a matter of necessity. Other areas seek to conserve as a way to reduce the costs and time needed to treat water and make it potable. In either event, all aspects of our daily lives are being examined to determine if water is being wasted. The bathroom is one area where water is often needlessly used.

Congress highlighted the importance of water conservation by enacting the Federal Energy Conservation Act, which regulates the amount of water toilets can use. Specifically, gravity tank-type toilets, flushometer tank toilets and electromechanical hydraulic toilets are now limited to 1.6 gallons per flush.

To further conserve water use, waterless urinals have been devised. These waterless urinals are not flushed with water each time a person uses the urinal and, in fact, they are not equipped for flushing as they are not connected to a water supply. As the waterless urinal is repeatedly used, urine is collected in a compartment of the urinal. An oily sealing liquid that is immiscible with the urine and is lighter than the urine covers the collected urine. This oily sealing liquid floats on the surface of the urine, serving as a barrier that prevents odors from the urinal from escaping to the environment. Typically, such waterless urinals include a removable cartridge having a top with an opening in communication with the compartment holding an initial water charge that mixes with urine flowing into the compartment through the opening. A stand pipe type drain is in communication with the compartment that allows the compartment to be drained continually to a sewer or other waste disposal system as the compartment is filled with urine.

A disadvantage of these waterless urinals is that the urinals are specially designed to accept these removable cartridges. For an institution to convert from water-based urinals to waterless urinals requires the complete replacement of the existing water-based urinals. This is an expensive and time-consuming process.

Therefore, what is needed is a device or system that can conserve water in significant amounts and reduce or eliminate the use of water in standard water-based urinals without requiring the physical and costly replacement of the water-based urinals with waterless urinals.

SUMMARY OF THE INVENTION

It is an object of the present invention to provide a device or system that converts a conventional water-based urinal into a water-conserving urinal. It is another object of the present invention to provide a method of reducing or eliminating the use of water in standard water-based urinals without the physical and costly replacement of the water-based urinal with a waterless urinal.

The present invention achieves these and other objectives by providing in one embodiment a composite urinal block made by combining 40-60% of a conventional urinal block and 40-60% of a specially formulated blended block composition. In another embodiment of the present invention, a urinal block assembly made by combining 40-60% of a conventional urinal block and 40-60% of a specially formulated blended block composition is provided in a urinal block holder.

In a further embodiment of the present invention, there is provided a water-conserving urinal block for use in a conventional water-based urinal where the water has been shut off, the block includes a first block portion forming about forty to sixty percent of the urinal block and a second block portion forming about forty to sixty percent of the urinal block. The first block portion has a first portion composition substantially similar to a conventional, non-paradichlorobenzene block used in water-based urinals for deodorizing during each flush. The second block portion has a second portion composition of a blended mixture of a non-paradichlorobenzene block portion, an odor counteractant gel, and a bacterial culture gel.

In a further embodiment of the present invention, the second block portion composition includes 30% to 60% of the non-paradichlorobenzene block portion of the second block portion, 25% to 35% of the odor counteractant gel by weight of the second block portion, and 25% to 35% of the bacterial culture gel by weight of the second block portion.

In another embodiment of the present invention, the non-paradichlorobenzene block portion is about 40% by weight, the odor counteractant gel is about 15% by weight and the bacterial culture gel is about 30% by weight of the second block portion.

In still another embodiment of the present invention, there is included a block holder having an interior chamber containing the first block portion and the second block portion, the block holder having a mesh body with a plurality of openings for liquid communication with the interior chamber.

In yet another embodiment, the present invention includes a securing band looped around the first block portion, the second block portion, and the mesh body, the securing band having an extended tail portion extending upwardly away from the top of the interior chamber.

In another embodiment of the present invention, the second block portion is wrapped in a water pervious but water insoluble covering.

In a further embodiment of the present invention, a method of using a water-based urinal without water is disclosed. The method includes obtaining a urinal block assembly that includes a first block portion comprising about forty to sixty percent of the urinal block assembly, the first block portion having a first portion composition substantially similar to a conventional, non-paradichlorobenzene block used in water-based urinals for deodorizing during each flush, and a second block portion comprising about forty to sixty percent of the urinal block assembly, the second block portion having a second portion composition comprising a blended mixture of a non-paradichlorobenzene block portion, an odor counteractant gel, and a bacterial culture gel. The urinal block assembly is then placed into a water-based urinal and the water supply to the water-based urinal is turned off and the water-based urinal is cleaned daily.

In another embodiment of the method of the present invention, a kit is provided having a block holder with a urinal block assembly and instructions. The urinal block assembly has a first block portion comprising about 40% to about 60% of the urinal block assembly where the first block portion is a conventional, non-paradichlorobenzene block used in water-based urinals for deodorizing during each flush. The urinal block assembly also has a second block portion comprising about 40% to about 60% of the block assembly where the second block portion has a composition made of a blended mixture of a non-paradichlorobenzene block portion, an odor counteractant gel, and a bacterial culture gel. The instructions instruct the user to place the block holder into the bottom of a water-based urinal, turn off the water supply to the water-based urinal and clean the urinal about once a day.

In a further embodiment of the present invention, a method of conserving water using a water-based urinal is provided. The method includes obtaining a urinal screen containing a urinal block assembly where 40% to 60% of the urinal block assembly is a blended mixture of a non-para block, a strong odor counteractant, and a bacterial culture gel, placing the urinal screen in the bottom of the urinal, and shutting off the water supply to the water-based urinal.

DETAILED DESCRIPTION OF THE PREFERRED EMBODIMENT

Figure 1:
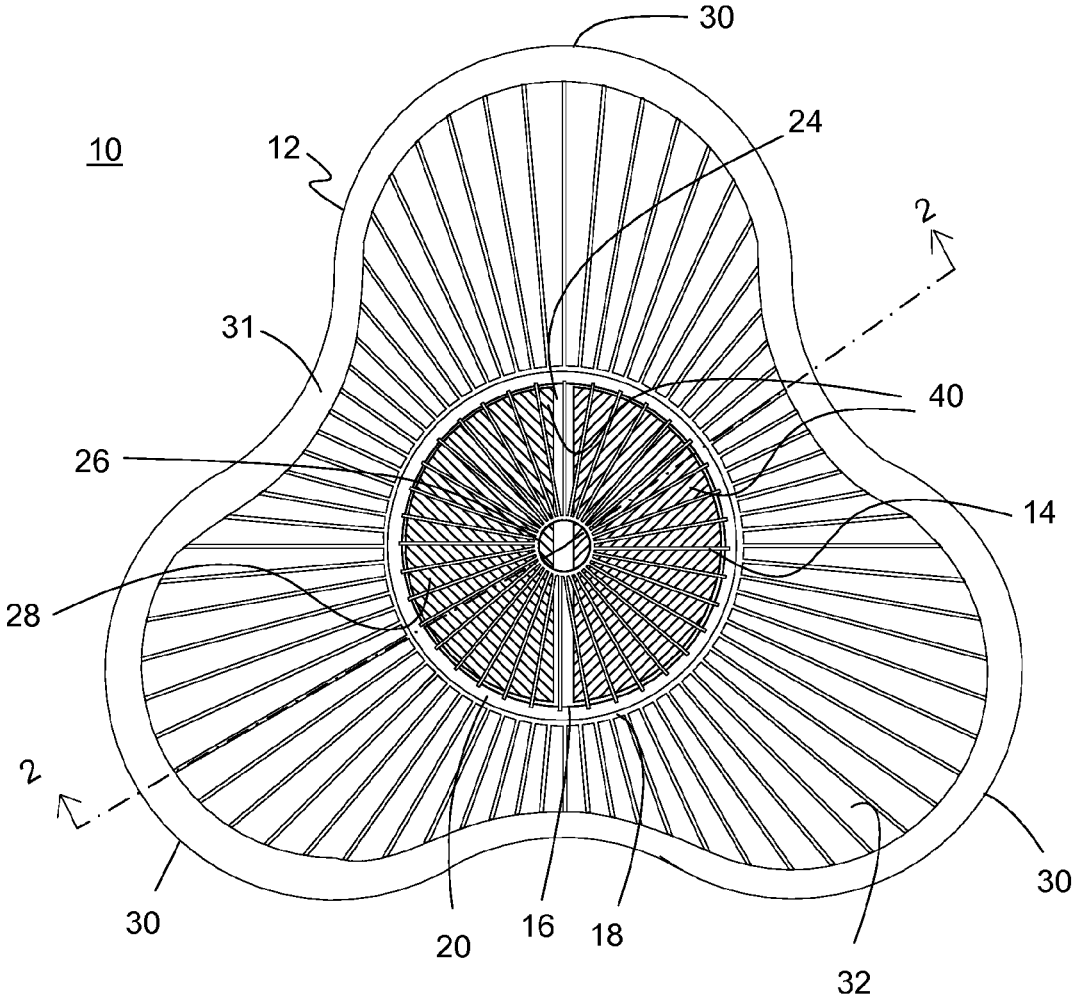
FIG. 1 is a top plan view of one embodiment of the present invention showing the urinal block holder and the urinal block assembly.

The preferred embodiment(s) of the present invention is illustrated in FIGS. 1-4. FIG. 1 shows a top plan view of one embodiment of the water-conserving urinal block and holder system 10 of present invention for use in a vertical type toilet or urinal. The urinal block and holder system 10 includes a block holder 12 and a urinal block assembly 40. Block holder 12 generally has a mesh body or grid body 14 and a central portion insert 21 (shown in FIG. 2). The mesh body or grid body 14 has a circular top 16, a base 18 and a cylindrical circumferential sidewall 20. An interior chamber 24 is defined by circular top 16, central portion insert 21 of base 18 and cylindrical circumferential sidewall 20. Central portion insert 21 serves as a bottom lid for interior chamber 24. Interior chamber 24 is utilized for holding urinal block assembly 40 to not only rid the urinal of the unpleasant odor of urine but also allow the water supply to the urinal to be shut off. Circular top 16 of mesh body 14 has a small circular central opening 26 and a plurality of slot openings 28 which extend from circular central opening 26 in a radial direction for allowing urine to flow therethrough. Base 18 also has a bottom support 31 shaped with three arches 30 with a plurality of slot openings 32 which extend outwardly from base 18.

Figure 2:
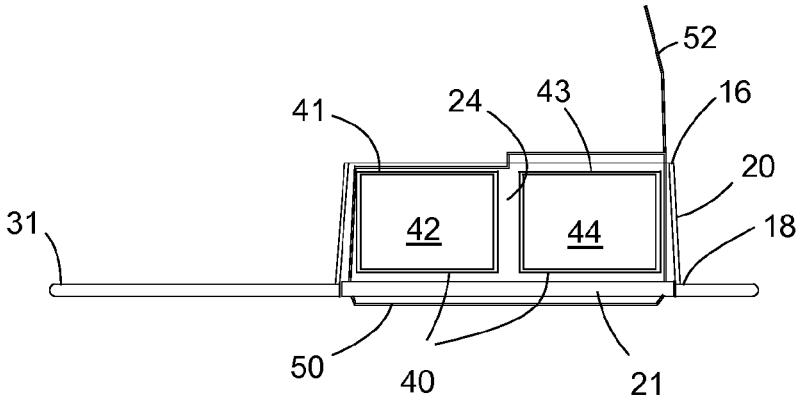
FIG. 2 is a cross-sectional view of the embodiment in FIG. 1 taken along line 2-2.

FIG. 2 is a cross-sectional view of the embodiment in FIG. 1 taken along line 2. Urinal block assembly 40 in one embodiment includes a first urinal block 42 and a second urinal block 44. Urinal block assembly 40 is disposed within interior chamber 24 and retained within interior chamber 24 by central portion insert 21. First urinal block 42 is made from a commercially available non-paradichlorobenzene (nonpara) urinal block. A nonpara urinal block is one that does not contain paradichlorobenzene. Typically, first urinal block 42 makes up about one-half of urinal block assembly 40 but could represent up to 60% of block assembly 40. Second urinal block 44 is specially formulated to provide, in conjunction with urinal block 42, a composition that permits use of a standard urinal with the water supply to the urinal being shut off. Second urinal block 44 is a mixture of three major components; a nonpara block, a strong odor counteractant mixture, and bacterial culture gel mixture. The nonpara block is preferably about 40% by weight of urinal block 44, the strong odor counteractant mixture is about 30% by weight of urinal block 44 and the bacterial culture gel mixture is about 30% by weight of urinal block 44.

One of the essential components of the nonpara block is an organic surfactant. One particularly useful nonpara block used as the base component in forming urinal block 44 is a product named Surfacto Toss block (Part No. 914—non-para blue block) available from Willert Home Products, Inc., St. Louis, Mo. Anionic, nonionic, ampholytic, zwitterionic or cationic surfactants can be used. The surfactant or surfactant mixture should be solid at ambient temperature, i.e. temperatures up to about 100° F. Anionics and nonionics and mixtures thereof are preferred. Anionics are the most preferred.

The anionic surfactants can be broadly described as the water-soluble salts, particularly the alkali metal salts. The inert salts (filler salts) used in the compositions of the present invention can be any water-soluble inorganic or organic salt or mixtures of such salts which do not destabilize the surfactant. Examples of suitable salts include various alkali metal and/or alkali earth metal sulfates, chlorides, borates, bromides, fluorides, phosphates, carbonates, bicarbonates, citrates, acetates, lactates, etc.

Specific examples of suitable salts include sodium sulfate, sodium chloride, potassium sulfate, sodium carbonate, lithium chloride, lithium sulfate, tripotassium phosphate, sodium borate, potassium bromide, potassium fluoride, sodium bicarbonate, magnesium sulfate, magnesium chloride, sodium citrate, sodium acetate, magnesium lactate, and sodium fluoride. The preferred salts are inorganic salts preferably the alkali metal sulfates and chlorides. Particularly preferred salts, because of their low cost, are sodium sulfate and sodium chloride.

Lithium sulfate in block composition at a level of from 0.1% to 0.8% by weight of the block is an effective stability agent for the block in the presence of trace hypochlorite solution. It provides solubility control benefits. A preferred range is 0.2% to 0.7%.

Organic salts are typically alkali metal salts of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals). Important examples of the anionic surfactants which can be employed in the practice of the present invention are the sodium or potassium alkyl sulfates, especially those obtained by sulfating the higher alcohols ($C_8$-$C_{18}$ carbon atoms); sodium or potassium alkyl benzene sulfonates, in which the alkyl group preferably contains from about 9 to about 15 carbon atoms, (the alkyl radical can be a straight or branched aliphatic chain); sodium or potassium alkyl naphthalene sulfonates containing one or two alkyl groups of 1 to about 6 carbon atoms each; paraffin sulfonate surfactants having the general formula $RSO_3M$, wherein R is a primary or secondary alkyl group containing from about 8 to about 22 carbon atoms (preferably 10 to 18 carbon atoms) and M is an alkali metal, e.g., sodium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil, and sodium or potassium β-acetoxy- or β-acetamido-alkane-sulfonates where the alkane has from 8 to 22 carbon atoms.

Many nonionic surfactants are liquids at ambient temperatures, thus it may be necessary to combine them with solid surfactants in order to formulate them into the solid block compositions.

The strong odor counteractant mixture is another key ingredient in the second urinal block 44. One particularly effective, chemical odor counteractant for the present invention is a product sold under the tradename Conqueror 103 Odor Counteractant (Part no. 12-32WB-MG-F) available from Fresh Products, Toledo, OHIO. The product is a liquid at room temperature and requires further evaporation forming a gel for use in formulating urinal block 44.

Figure 3:
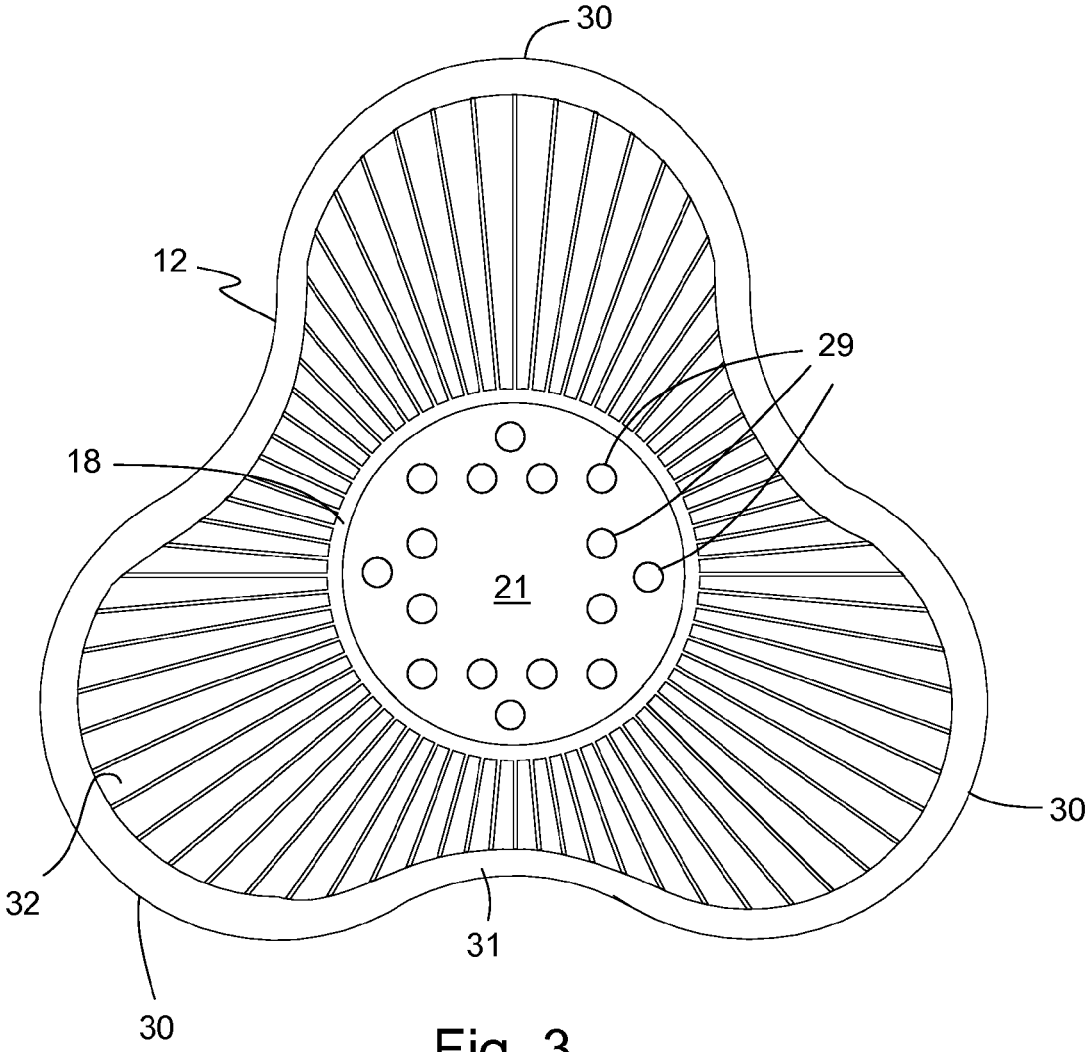
FIG. 3 is a bottom plan view of the embodiment in FIG. 1 showing the plurality of small openings.

Turning now to FIG. 3, there is illustrated a bottom plan view of the embodiment shown in FIG. 1. Central portion insert 21 of base 8 of mesh body 4 has a plurality of small openings 29. The plurality of small openings 29 serves as an egress for urine and dissolved chemicals from first and second urinal blocks 42, 44.

Figure 4:
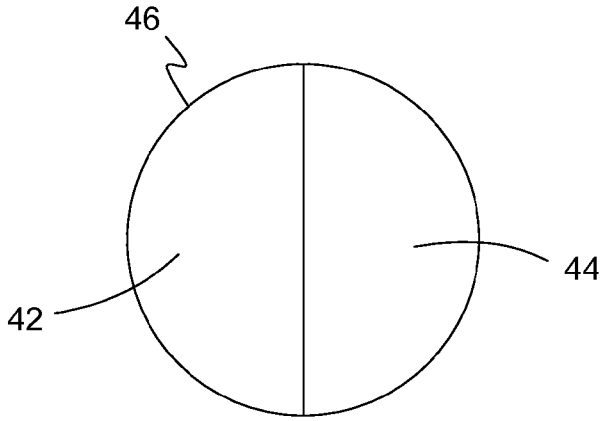
FIG. 4 is a top plan view of one embodiment of the composite urinal block of the present invention.

In the embodiment illustrated in FIG. 1, first and second urinal blocks 42, 44 are packaged as separate blocks within interior chamber 24. It should be understood that first and second urinal blocks 42, 44 may be combined into a single, integral urinal block. FIG. 4 shows one embodiment of such a single, integrally combined urinal block 46 that is made up of first urinal block 42 and second urinal block 44. Urinal block 46 may be any structural combination of first and second urinal blocks 42, 42 such as horizontal, vertical, angular, layered, and the like. Additionally and optionally, the mixture of second urinal block 44 may represent 40-80% of the urinal block assembly 40 of water-conserving urinal block and holder system 10. It should be understood that the components of urinal blocks 42, 44 may be combined to form a unitary urinal block.

Formulation of the Urinal Block Assembly

Urinal block 42 is formed by cutting a conventional, commercially-available nonpara urinal block in half and packaging urinal block 42 into interior chamber 24 of urinal block holder 12. An acceptable nonpara urinal block for use as urinal block 42 is packaged in a conventional urinal screen that is available from Noury Supply, Manchester, N.H. as product number FRS12 SANI Urinal Screen Block or IMP9480G Urinal Screen Block. Conventional urinal blocks are typically packaged in a water soluble bag-type covering and shown in FIG. 2 as soluble covering 41. In the present invention, the use of such a water-soluble covering is optional.

Urinal block 44 is specially formulated using three component mixtures. The first component forms the body of urinal block 44. The body of urinal block 44 is a nonpara block available from Willert Home Products, St. Louis, Mo. under part no. 914. It also known as Surfacto™ toss block. It is a surfactant with adjuvants and provides the block forming properties to urinal block 44. The nonpara block makes up about 30-60% by weight of the finished urinal block 44, prefereably about 40% by weight. A strong, odor counteractant mixture and a bacterial culture gel mixture are blended into the nonpara block.

The second component is the strong, odor counteractant mixture. The strong, odor counteractant mixture is available from Fresh Products, Toledo, Ohio under the tradename Conqueror 103 Odor Counteractant, part no. 12-32WB-MG-F. The odor counteractant mixture is a liquid substance having a viscosity about that of water. For use in the blended block of the present invention, the counteractant mixture is evaporated to a gel state. It is the gel form of the counteractant mixture that is weighed and used to blend into the nonpara block. The gel form of the counteractant is typically an amount in the range of about 25-35% by weight of the urinal block 44 and, preferably, about 30% by weight. The odor counteractant mixture includes a non-ionic surfactant blend, water and a proprietary fragrance. None of the prior art urinal blocks include such a strong odor counteractant. In fact, it was unexpected that the specially formulated urinal block 44 along with cleaning the urinal once daily would control the odor in the urinal where the water was shut off. The odor counteractant mixture may additionally contain anionic surfactant and bacterial cultures.

The third component is the bacterial cultures gel mixture. The bacterial cultures gel mixture is available from Fresh Products, Toledo, Ohio under the trademark Bio-Snake® Drain Gel. As the name implies, it is a gel made from a mixture of polyvinyl alcohol, viable bacterial cultures and water. The amount of the bacterial culture gel mixture used is typically an amount in the range of about 25 to 35% by weight of the urinal block 44 and, preferably, about 30% by weight. The two gelled components are blended with the nonpara block to form urinal block 44. A quantity in an amount substantially similar in size and shape to urinal block 42 is disposed into the interior chamber 24 of block holder 12 next to urinal block 42. Central portion insert 21 is added to block holder 12 enclosing urinal blocks 42, 44 within interior chamber 24. Composite urinal block 44 may also be covered by a water-soluble film as presently used in conventional urinal blocks. Composite urinal block 44 may optionally include a water pervious but water insoluble covering as shown in FIG. 2 as covering 43. An example of a usable water-pervious and water-insoluble covering is a paper covering such as that used for a paper napkin or towel. Any material is usable for a covering so long as the material allows the urine stream to penetrate through to urinal block 44, prevents splashing of the components of urinal block 44 and, yet, is not itself water soluble. The advantage of using such a covering is that the covering prevents splashing of the dissolved chemical components when a urine stream impinges on urinal block 44. Splashing of the dissolved chemical components in the urinal causes unsightly "stain" lines since no water is being used to flush the urinal. The paper wrap prevents the splashing and the interior chamber 24 retains the paper wrap after urinal block 44 is completely dissolved. Thus, any potential clogging from the paper wrap is prevented. It should be understood that the conventional material used to cover conventional nonpara blocks does not prevent splashing of the components in the block because the material is water soluble and dissolves away exposing the nonpara block Additional ingredients may be included in urinal block 44 such as enzymes, germicides/disinfectants, scale removers, dyes, and the like.

Urinal block holder 12 is known in the trade as a urinal screen and is typically made of a thermoplastic material. These urinal screens are readily available and one such urinal screen is available from Worldwide Integrated Resources, Inc. as part no. R7858WWIR.

The central portion insert 21 is typically retained and connected to block holder 12 by small, integrally formed tabs. An optional feature of the present invention includes the use of a securing band 50 such as a plastic tie and, more preferably, a cable tie surrounding urinal blocks 42, 44 and passing through central portion insert 21 and mesh body 14 to prevent the accidental disengagement of central portion insert 21 during shipping, handling and transportation. An additional optional feature of the securing band 50 is the inclusion of an extended tail portion 52 of securing band 50. Extended tail portion 52 provides a means for grabbing block holder 12 and removing it from a urinal for easy disposal when replacement is needed.

To use the water-conserving urinal block and holder system of the present invention, a urinal is cleaned, a urinal block and holder system of the present invention is placed within the bottom of the urinal, and the water is shut off. The urinal should be cleaned once a day. Each urinal block and holder of the present invention will last up to about one month before needing replacement.

A major advantage of the present invention is the savings in water that can be achieved without having to replace the current water-based urinal with a water-less urinal. The formulation of the urinal block assembly is completely water soluble and will not clog drains. The formulation lasts up to thirty (30) days with no water supply. Most urinals flush 1.5 or 1.6 gallons of water per flush. Based on an average urinal usage per day of 25 flushes, approximately 37.5 to 40 gallons of water per urinal per day are used. For an average 30-day month, that amounts to 1,125 to 1,200 gallons of water used by one conventional urinal. Using the present invention and turning off the water, which effectively converts the conventional urinal into a "water-less" or, at the least, a water-conserving urinal, can mean an annual savings of 13,500 to 14,400 gallons of water per year per urinal. In addition to the savings in water usage, additional savings are obtained by the reduced fees charged by the local water treatment plant as sewerage fees, which are typically based on water usage. Where each urinal using the apparatus and method of the present invention will reduce the amount of water used by the urinals, a lower charge for sewerage fees will also occur.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A urinal block for use in a conventional water-based urinal where the water has been shut off, the urinal block comprising:

a first block portion comprising about forty to sixty percent of the urinal block, the first block portion having a first portion composition substantially similar to a conventional, non-paradichlorobenzene block used in water-based urinals for deodorizing during each flush;

a second block portion comprising about forty to sixty percent of the urinal block, the second block portion having a second portion composition comprising:

a non-paradichlorobenzene block portion;

an odor counteractant gel wherein the odor counteractant gel is present in an amount of about 15% or more by weight of the second block portion; and a bacterial culture gel wherein the odor counteractant gel and the bacterial culture gel are blended into the non-paradichlorobenzene block portion; and a liquid-pervious and liquid-insoluble layer covering at least the second block portion wherein the layer is configured to allow a urine stream to penetrate through to the second block portion while preventing splashing of dissolved components of second block portion that causes unsightly stain lines in the conventional water-based urinal since the water has been shut-off and no water is being used to flush the urinal.

2. The urinal block of claim 1 wherein the second block portion composition includes 30% to 60% of the non-paradichlorobenzene block portion of the second block portion, 25% to 35% of the odor counteractant gel by weight of the second block portion, and 25% to 35% of the bacterial culture gel by weight of the second block portion.

3. The urinal block of claim 2 wherein the non-paradichlorobenzene block portion is about 40% by weight, the odor counteractant gel is about 15% by weight and the bacterial culture gel is about 30% by weight of the second block portion.

4. The urinal block of claim 1 further comprising a block holder having an interior chamber containing the first block portion and the second block portion, the block holder having a mesh body with a plurality of openings for liquid communication with the interior chamber.

5. The urinal block of claim 4 further comprising a securing band looped around the first block portion, the second block portion, and the mesh body, the securing band having an extended tail portion extending upwardly away from the top of the interior chamber.

6. The urinal block of claim 4 further comprising instructions for converting a water-based urinal to a water-conserving urinal.

7. A combination for conserving water in a bathroom having a urinal connected to a water supply, the combination comprising:

a water-based urinal having the water supply shut off; and a urinal block system comprising:

a first block portion that is a conventional deodorant urinal block used in water-based urinals for deodorizing during each flush of the urinal;

a second block portion containing a plurality of dissolvable chemical components where the second block portion is a blended mixture of a nonparadichlorobenzene block, an odor counteractant gel wherein the odor counteractant gel is present in an amount of about 15% or more by weight of the second block portion and a bacterial culture gel; and a liquid-pervious and liquid insoluble layer covering at least the second block portion, the layer being configured to allow a urine stream to penetrate through to the second block portion while preventing splashing of dissolvable components of second block portion that causes unsightly stain lines when impinged upon by a urine stream since the water is shut off and no water is being used to flush the urinal due to the water supply being shut off.

8. The combination of claim 7 wherein the urinal block system further includes a block holder having an interior chamber containing the first block portion and the second block portion, the block holder having a mesh body with a plurality of openings for liquid communication with the interior chamber.

9. The combination of claim 8 wherein the urinal block system includes instructions for converting a water-based urinal to a water-conserving urinal using the urinal block system.

10. The combination of claim 8 further comprising a securing band looped around the first block portion, the second block portion, and the mesh body, the securing band having an extended tail portion extending upwardly away from the top of the interior chamber.

11. A water-conserving urinal kit for conventional water-based urinals where the water supply to the urinal is shut off, the kit comprising:

a urinal block comprising:

a first block portion that is a conventional deodorant urinal block used in water-based urinals for deodorizing during each flush of the urinal;

a second block portion containing a plurality of dissolvable chemical components where the second block portion is a blended mixture of a nonparadichlorobenzene block, an odor counteractant gel wherein the odor counteractant gel is present in an amount of about 15% or more by weight of the second block portion and a bacterial culture gel; and a liquid-pervious and liquid insoluble layer covering at least the second block portion, the layer being configured to prevent splashing of dissolvable chemical components of the second block portion when impinged upon by a urine stream that causes unsightly stain lines in the conventional water-based urinal since the water has been shut off and no water is being used to flush the urinal due to the water supply having been shut off; and instructions for converting a water-based urinal to a water-conserving urinal using the urinal block.

12. The kit of claim 11 further comprising a block holder having an interior chamber containing the first block portion and the second block portion, the block holder having a mesh body with a plurality of openings for liquid communication with the interior chamber.

13. The kit of claim 12 further comprising a securing band looped around the first block portion, the second block portion, and the mesh body, the securing band having an extended tail portion extending upwardly away from the top of the interior chamber.

14. The kit of claim 11 wherein the second block portion composition includes 30% to 60% of the non-paradichlorobenzene block portion of the second block portion, 25% to 35% of the odor counteractant gel by weight of the second block portion, and 25% to 35% of the bacterial culture gel by weight of the second block portion.

15. The kit of claim 14 wherein the non-paradichlorobenzene block portion is about 40% by weight, the odor counteractant gel is about 15% by weight and the bacterial culture gel is about 30% by weight of the second block portion.

16. The combination of claim 7 wherein the second block portion composition includes 30% to 60% of the non-paradichlorobenzene block portion of the second block portion, 25% to 35% of the odor counteractant gel by weight of the second block portion, and 25% to 35% of the bacterial culture gel by weight of the second block portion.

17. The combination of claim 16 wherein the non-paradichlorobenzene block portion is about 40% by weight, the odor counteractant gel is about 15% by weight and the bacterial culture gel is about 30% by weight of the second block portion.

* * * * *